US007124703B2

(12) United States Patent
Richard et al.

(10) Patent No.: US 7,124,703 B2
(45) Date of Patent: Oct. 24, 2006

(54) CONVERTIBLE PERSONAL WATERCRAFT

(75) Inventors: Simard Richard, St-Charles de Drummond, CA (US); Francois Giroux, Valcourt, CA (US); Shannon Cassel, Pickens, SC (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/913,316

(22) Filed: Aug. 9, 2004

(65) Prior Publication Data

US 2005/0016440 A1 Jan. 27, 2005

Related U.S. Application Data

(60) Provisional application No. 60/492,992, filed on Aug. 7, 2003.

(51) Int. Cl.
*B63B 17/00* (2006.01)

(52) U.S. Cl. ..... 114/363; 114/55.52; 114/55.56; 114/55.57

(58) Field of Classification Search ..... 114/363, 114/55.5, 55.52, 55.56, 55.57
See application file for complete search history.

(56) References Cited

U.S. PATENT DOCUMENTS

| | | | | |
|---|---|---|---|---|
| 5,282,437 | A * | 2/1994 | Avillez de Basto | 114/345 |
| 6,152,062 | A * | 11/2000 | Hattori | 114/343 |
| 2004/0003767 | A1 * | 1/2004 | Adamczyk et al. | 114/363 |

* cited by examiner

*Primary Examiner*—Sherman Basinger
(74) *Attorney, Agent, or Firm*—Osler, Hoskin & Harcourt LLP

(57) ABSTRACT

A seat assembly for a personal watercraft, comprises a seat portion. A support portion is connected to the seat portion, and is adapted to connect the seat portion to the personal watercraft in a seating position of the seat assembly, in which a rider of the personal watercraft is in a seated position on the personal watercraft. A storable configuration is provided between the seat portion and the support portion, for the seat assembly to be displaceable while being connected to the personal watercraft between the seating position and a collapsed position in which the seat assembly is adapted to be stored in the personal watercraft, such that the rider of the personal watercraft can be in a standing or kneeling position on the personal watercraft.

16 Claims, 16 Drawing Sheets

CONVERTIBLE PERSONAL WATERCRAFT

PRIORITY CLAIM

This application claims priority on U.S. provisional application Ser. No. 60/492,992, filed Aug. 7, 2003, and titled "Convertible personal watercraft". Both this application and U.S. application Ser. No. 10/427,911. filed May 2, 2003, and titled "Convertible Personal Watercraft" are incorporated herein by reference in their entirety.

BACKGROUND OF THE INVENTION

1. Field of the Invention

The present invention generally relates to personal watercraft and, more particularly, to a personal watercraft that is convertible for stand-up type riding and seated type riding.

2. Background Art

Personal watercraft (hereinafter PWC) have become commonplace in the nautical industry. The PWC consists of a versatile vehicle, that is used for touring and as a nautical sport vehicle. In the touring use, the PWC comprises seating such that the rider is seated in riding the PWC. The rider of such a PWC may be in a straddle position, or in a karting position.

When used as a nautical sport vehicle, the PWC comprises a standing surface on its deck, whereupon the rider stands or kneels to ride the PWC. This type of PWC appeals to a different type of rider than a typical seated-type PWC in which the rider may travel over longer distances more comfortably, as this type of PWC involves a more sporty style of riding. The stand-up type of PWC is less stable than the seated-type PWC as the rider can freely move around on the stand-up PWC or adopt various standing stances, and thus causes a change the center of gravity of the stand-up PWC.

Unfortunately, if a person enjoys operating more than one type of PWC, he/she must physically use more than one PWC to get the full experience that PWCs can offer. Moreover, if more than one person operates the same PWC, the riding style is limited to the type of PWC available.

Therefore, there is a need for a single PWC that gives the rider an option on the style of riding he or she wants to use at any given outing. Such type of PWC should also be configured to allow a rapid change in riding configuration, such that the rider may change riding styles off shore if desired. Therefore, there is a need for PWCs having components for a change in riding configuration (e.g., seat) stored within the PWCs.

SUMMARY OF INVENTION

It is therefore an aim of an aspect of the present invention to provide a personal watercraft having a seat assembly that may be stored within the personal watercraft.

It is a further aim of an aspect of the present invention to provide a seat assembly that has a storage configuration for being stored within a personal watercraft.

It is a further aim of the present invention to provide a method for storing a seat assembly within a personal watercraft.

Therefore, in accordance with the present invention, there is provided a personal watercraft comprising a hull; a deck supported by the hull, the deck having a standing surface; a propulsion system supported by the hull; a steering assembly supported by the deck; and a seat assembly displaceably supported by the deck such that the seat assembly is displaceable between a seating position, in which the seat assembly is positioned above the standing surface for seated type riding of the personal watercraft, and a collapsed position, in which the seat assembly is stored in the personal watercraft, so that the standing surface is unencumbered to be used in stand-up type riding of the personal watercraft.

Further in accordance with the present invention, there is provided a seat assembly for a personal watercraft, comprising a seat portion; a support portion connected to the seat portion, and adapted to connect the seat portion to the personal watercraft in a seating position of the seat assembly, in which a rider of the personal watercraft is in a seated position on the personal watercraft; and a storable configuration between the seat portion and the support portion, for the seat assembly to be displaceable while being connected to the personal watercraft between the seating position and a collapsed position in which the seat assembly is adapted to be stored in the personal watercraft, such that the rider of the personal watercraft can be in a standing or kneeling position on the personal watercraft.

Still further in accordance with the present invention, there is provided a method for storing a seat assembly in a personal watercraft, comprising the steps of i) releasing the seat assembly from a seating position on a deck of the personal watercraft; and ii) pivoting the seat assembly to a collapsed position in the personal watercraft; whereby the seat assembly is stored within the personal watercraft.

Still further in accordance with the present invention, there is provided a method for deploying a seat assembly from a collapsed position to a seating position on a personal watercraft, comprising the steps of i) pivoting the seat assembly about the personal watercraft from a collapsed position in the personal watercraft to a position above a standing surface of the deck of the personal watercraft; and ii) setting the seat assembly to a seating position with respect to the deck of the personal watercraft; whereby the seat assembly is adapted to be used in seated type riding of the personal watercraft.

BRIEF DESCRIPTION OF THE DRAWINGS

Having thus generally described the nature of the invention, reference will now be made to the accompanying drawings, showing by way of illustration a preferred embodiment thereof and in which.

An annex of Figures is provided following FIGS. 1 to 16.

DESCRIPTION OF THE PREFERRED EMBODIMENTS

Figure 1:
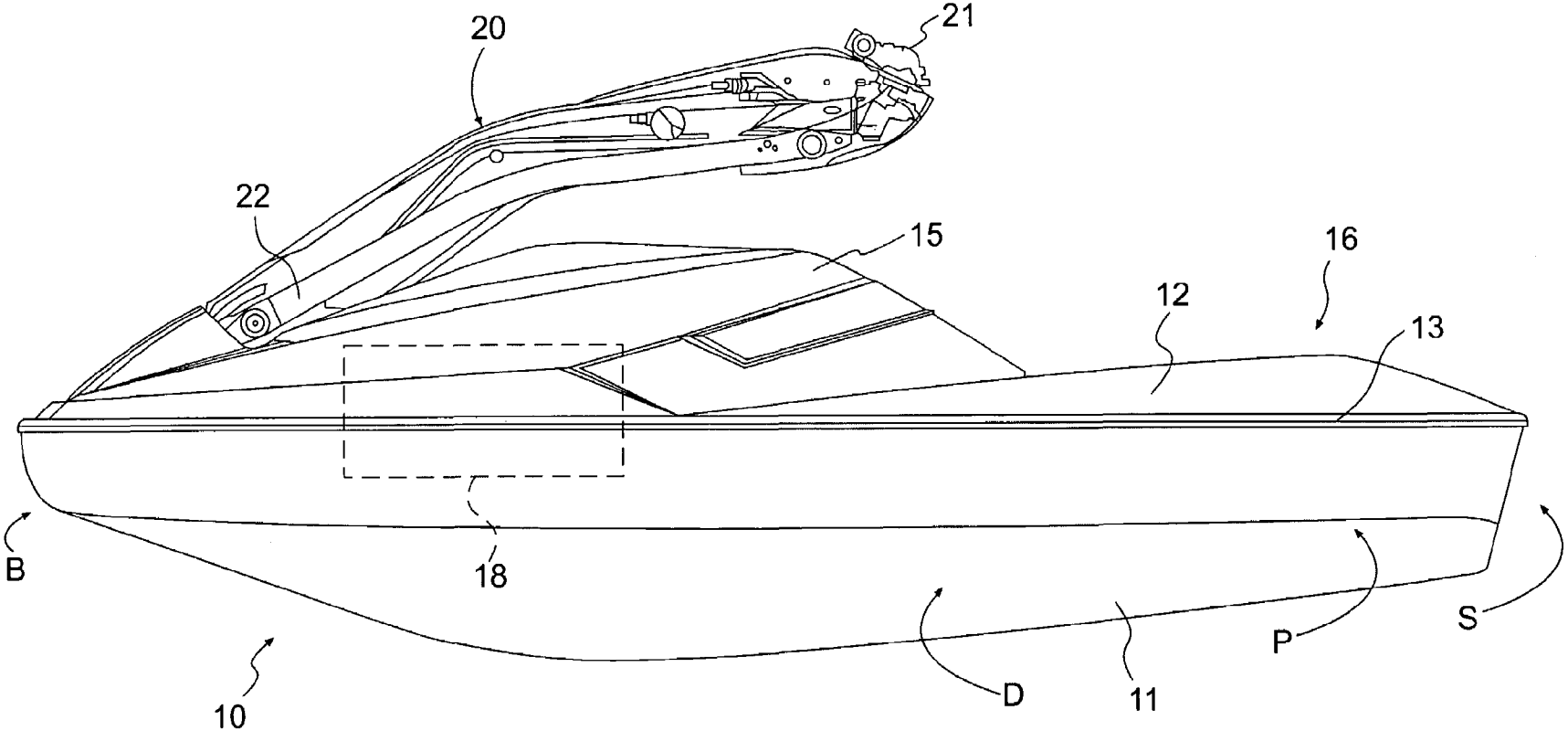
FIG. 1 is a port-side elevation view of a personal watercraft in accordance with the present invention.

Referring to the drawings and, more particularly to FIG. 1, a personal watercraft in accordance with the present invention is generally shown at 10 (hereinafter PWC 10). The PWC 10 is configured so as to be convertible, i.e., so as to allow stand-up type riding and seated type riding. The PWC 10 has a bow B, a stern S, a port side P and a starboard side D. The PWC 10 has two main parts, namely a hull 11 and a deck 12. The hull 11 buoyantly supports the personal watercraft 10 in a body of water. The hull 11 and the deck 12 are sealed together at bond line 13. The space between the hull 11 and the deck 12 forms a cavity that accommodates an engine 14, as well as other components such as, non exhaustively, a gas tank, an electrical system (battery, electronic control unit, drive shaft, etc.), which form, together with the engine 14, the propulsion system of the PWC 10.

An engine cover 15 of the deck 12 is generally positioned above the engine 14, and is openable so as to provide access to the engine 14. For instance, a foremost edge of the engine cover 15 may be hinged to the deck 12, for opening the engine cover 15. A standing surface 16 is defined between the engine cover 15 and the stern S of the PWC 10.

The PWC 10 has a steering assembly 20 pivotally connected to the deck 12 at the bow. B. The steering assembly 20 can be maintained at any given position with respect to the deck 12. The steering assembly 20 including a push pull cable is provided for the-steering of the PWC 10, and includes a cable portion in the cavity of the PWC 10, by which the PWC 10 will be guided, as a function of the steering of the, rider. More specifically, the steering assembly 20 has a steering handle 21 (or, alternatively, a steering wheel, etc . . . ), having finger throttles for controlling the speed of the PWC 10.

The steering assembly 20 also has a pair of poles 22, that support the steering handle 21. The poles 22 are spaced from one another, and are pivotally mounted to the deck 12. Accordingly, the steering handle 21 can be displaced vertically and/or longitudinally through a pivoting of the poles 22. The vertical and/or longitudinal adjustment of the steering handle 21 is convenient, in view of the various riding style configurations of the PWC 10. For stand-up type riding of the PWC 10, the steering assembly 20 may be fixed with respect to the deck 12, by way of an added-on support bar (not shown), that sets the steering assembly 20 with respect to the deck 12.

Figure 2:
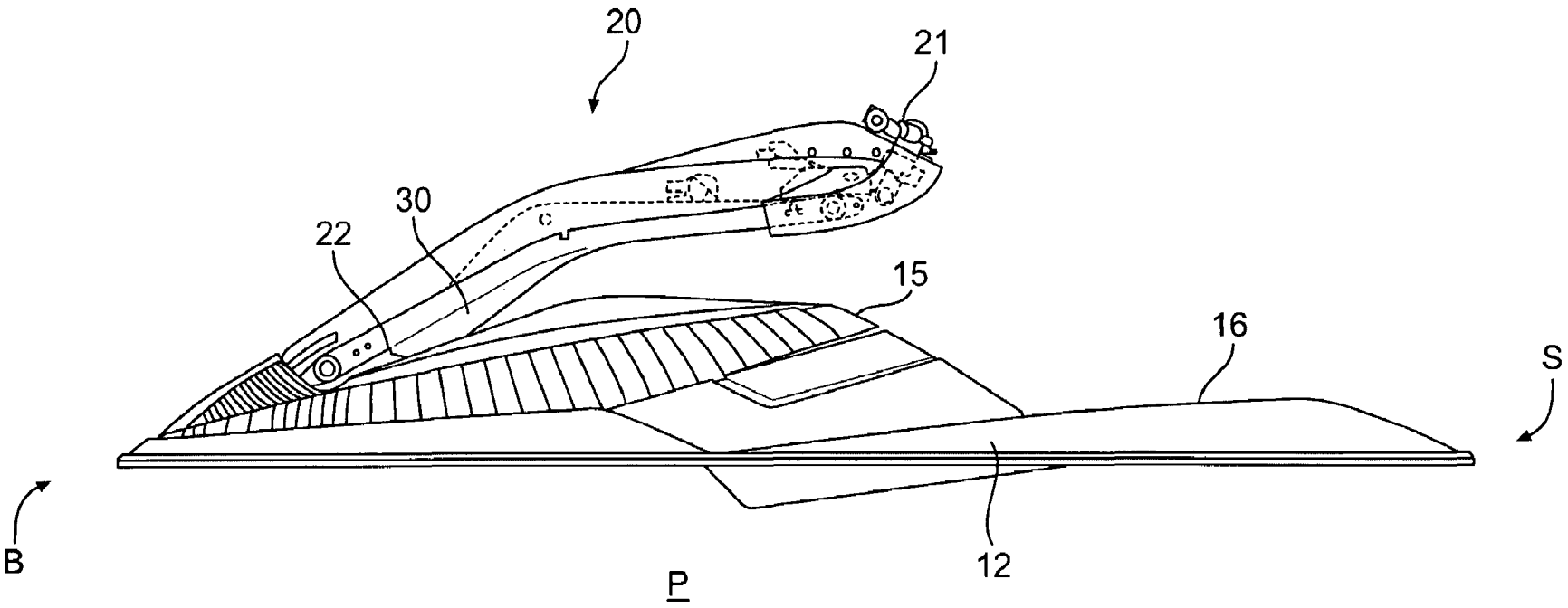
FIG. 2 is a port-side elevation view of the personal watercraft with a hull thereof removed, in a stand-up configuration.

Referring to FIGS. 2, 3, 4 and 5, the PWC 10, without the hull 11, is shown in four different configurations, associated with the position of a seat assembly 30, the position of which will direct the style of riding of the PWC 10. In FIG. 2, the PWC 10 is in a stand-up configuration, in which a rider adopts a standing or kneeling position on the standing surface 16. In the stand-up configuration, the seat assembly 30 of the PWC 10 is in a collapsed position, so as not to interfere with the rider of the PWC 10.

Figure 3:
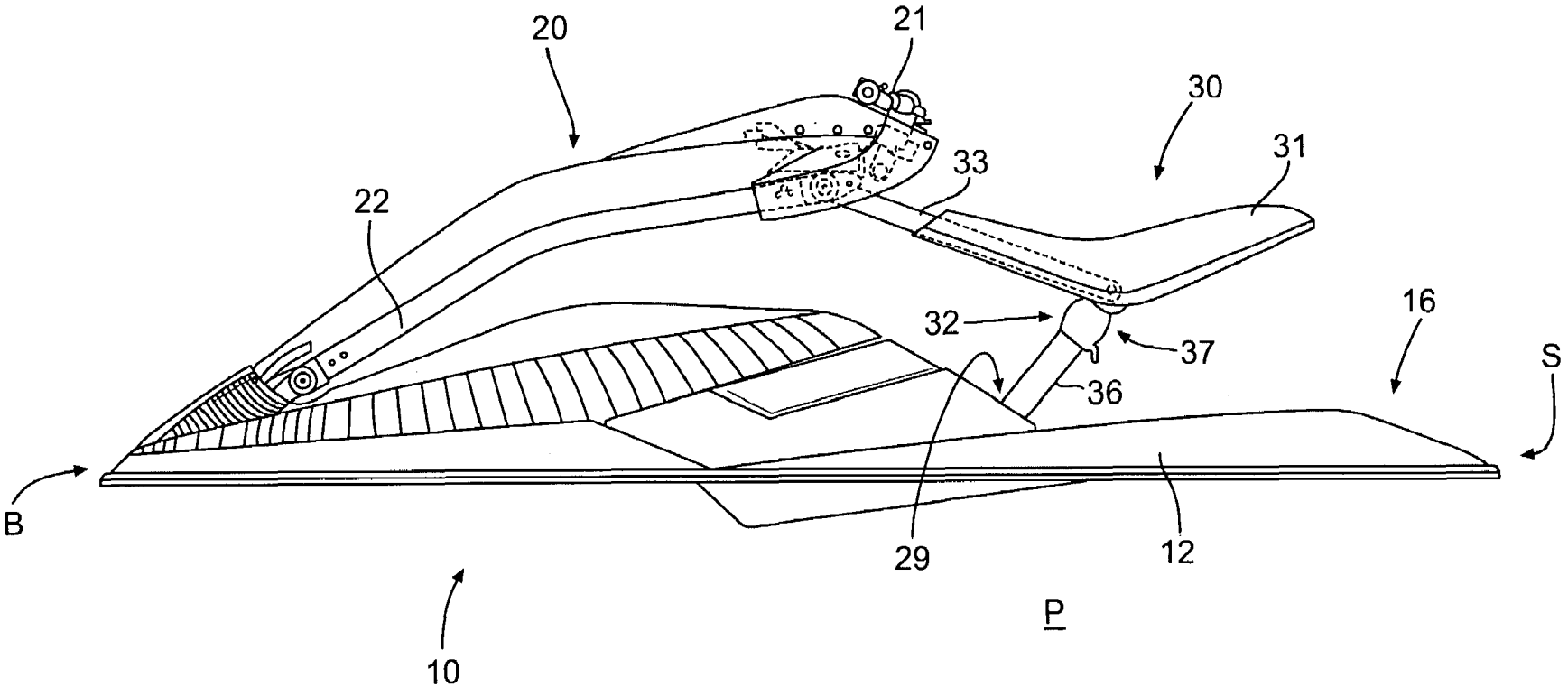
FIG. 3 is a port-side elevation view of the personal watercraft without the hull, in a straddle seating configuration.

In FIG. 3, the PWC 10 is in a straddle seating configuration, in which the seat assembly 30 is in a first seating position and the rider adopts a straddle sitting position. The seat assembly 30 has a seat portion 31. In the straddle seating configuration, the seat portion 31 is positioned above and spaced from the standing surface 16.

Figure 4:
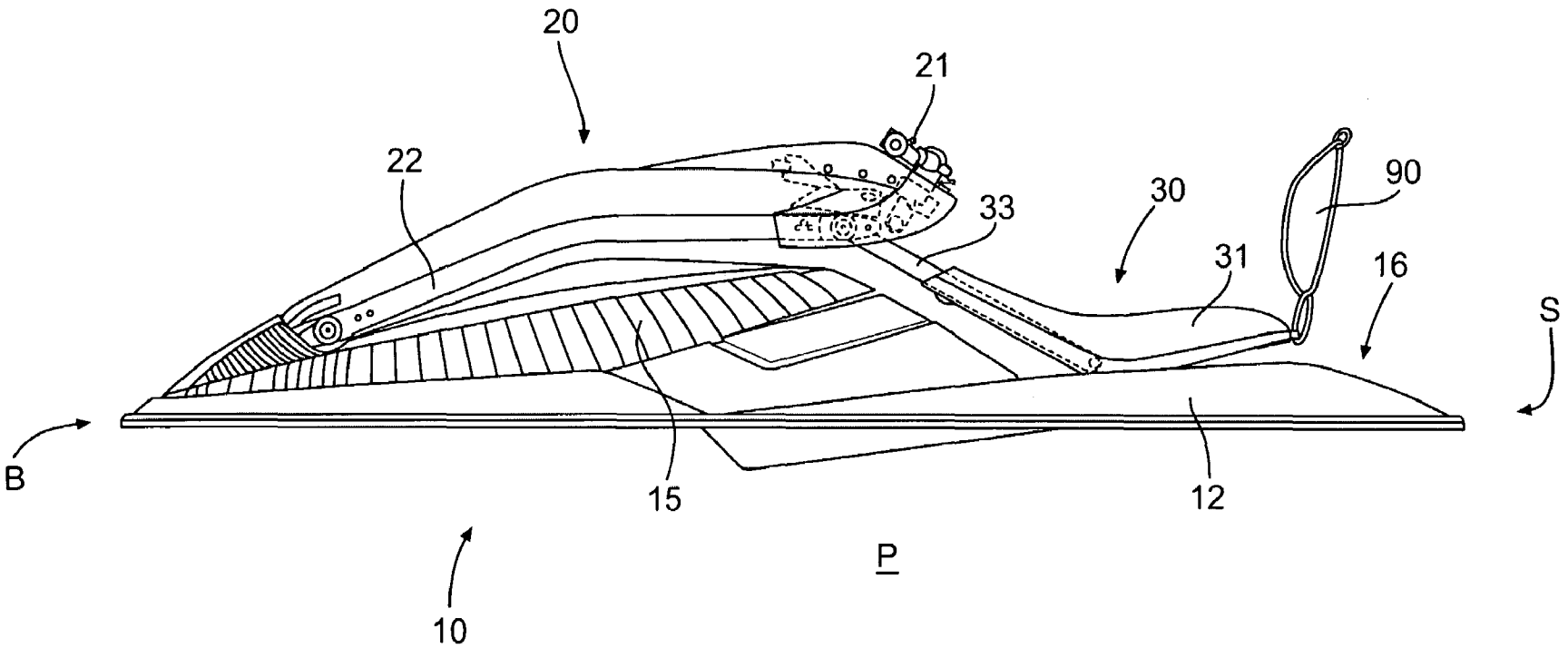
FIG. 4 is a port-side elevation view of the personal watercraft without the hull, in a karting seating configuration.

In FIG. 4, the PWC 10 is in a karting seating configuration, in which the seat assembly 30 is in a second seating position while the rider adopts a karting sitting position. In the karting seating configuration of the PWC 10, the seat portion 31 lies on the standing surface 16.

Figure 5:
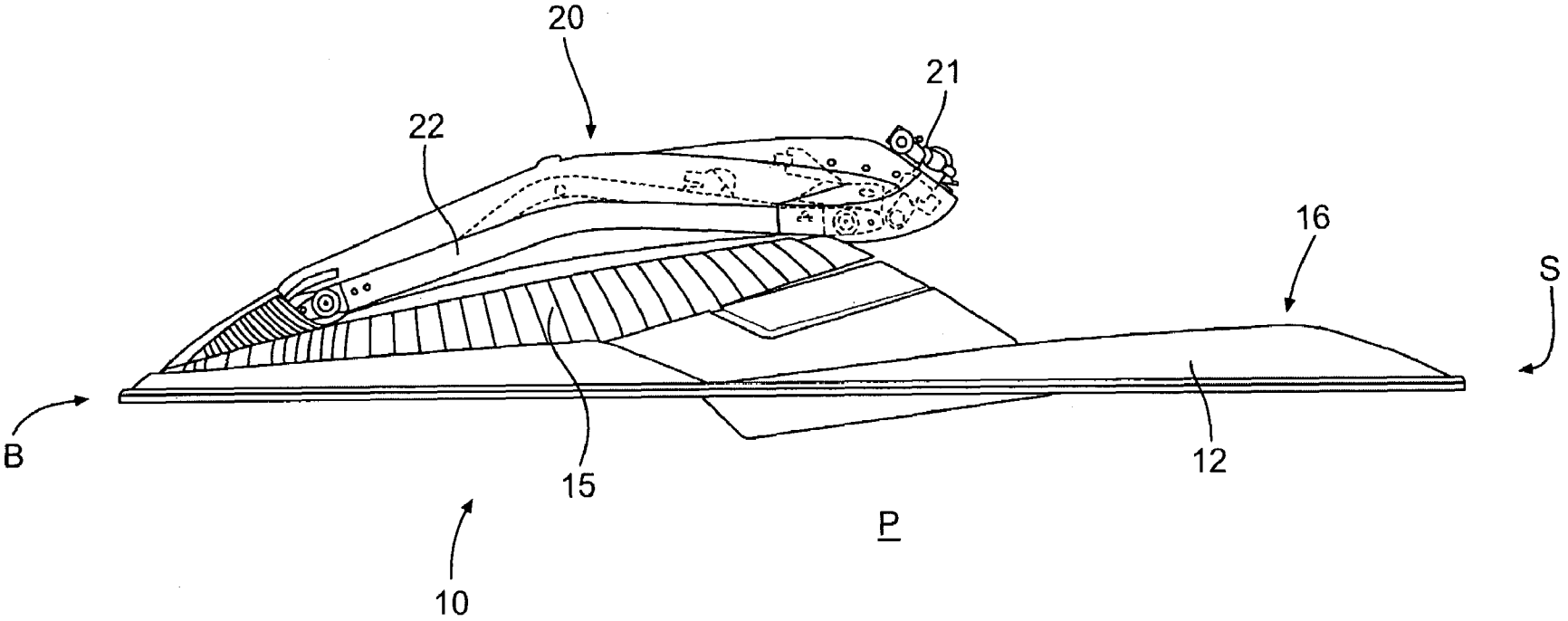
FIG. 5 is a port-side elevation view of the personal watercraft without the hull, in a storage configuration.

In FIG. 5, the PWC 10 is shown in a storage configuration. In the storage configuration, the PWC 10 has the steering assembly 20 lying on the engine cover 15 of the deck 12, with the seating assembly 30 in its collapsed position with respect to the PWC 10. The PWC 10 is preferably in the storage configuration when the PWC 10 is not being used, or when it is transported or stored.

Seat Assembly

Figure 6:
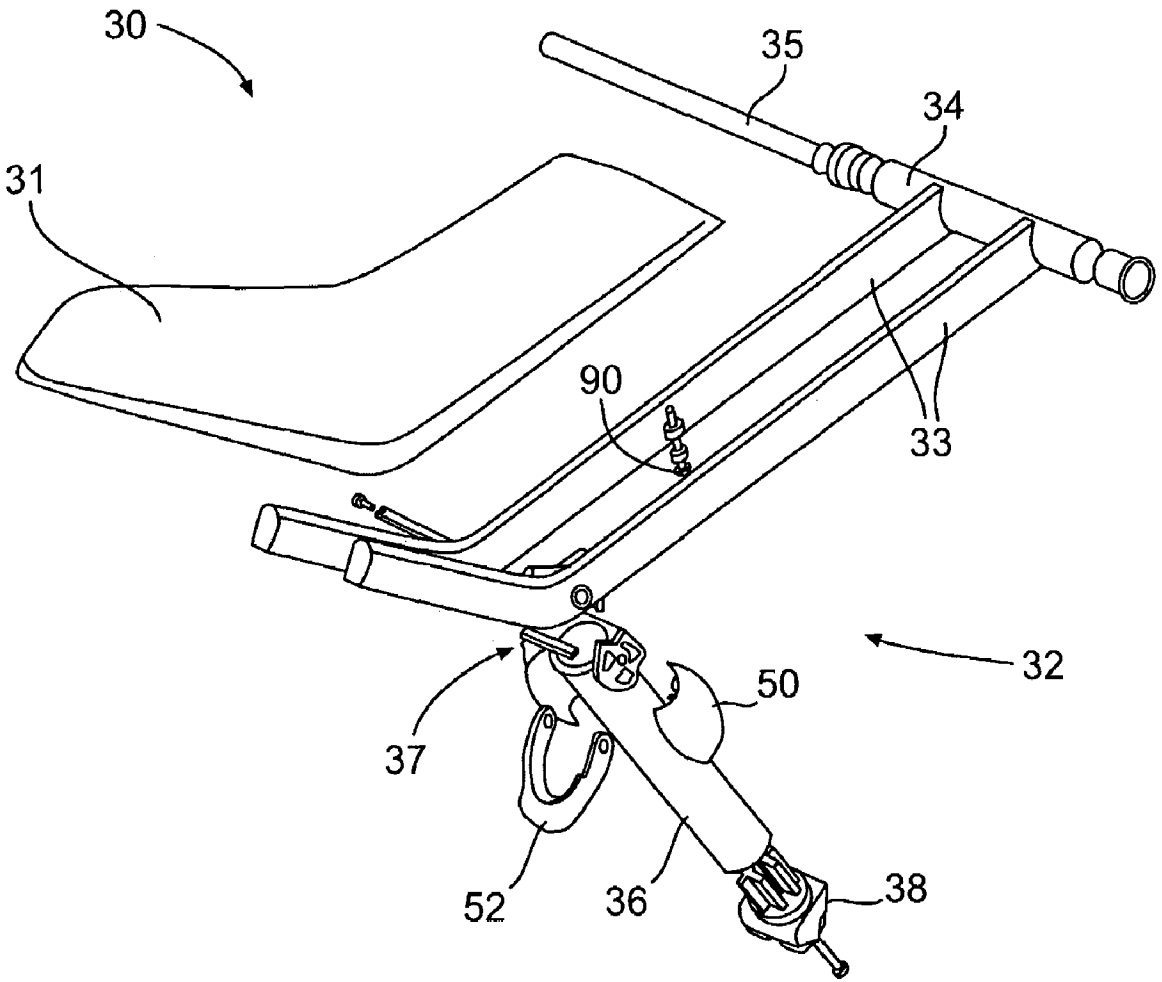
FIG. 6 is an exploded view of a seat assembly in accordance with an aspect of the present invention.
Figure 7:
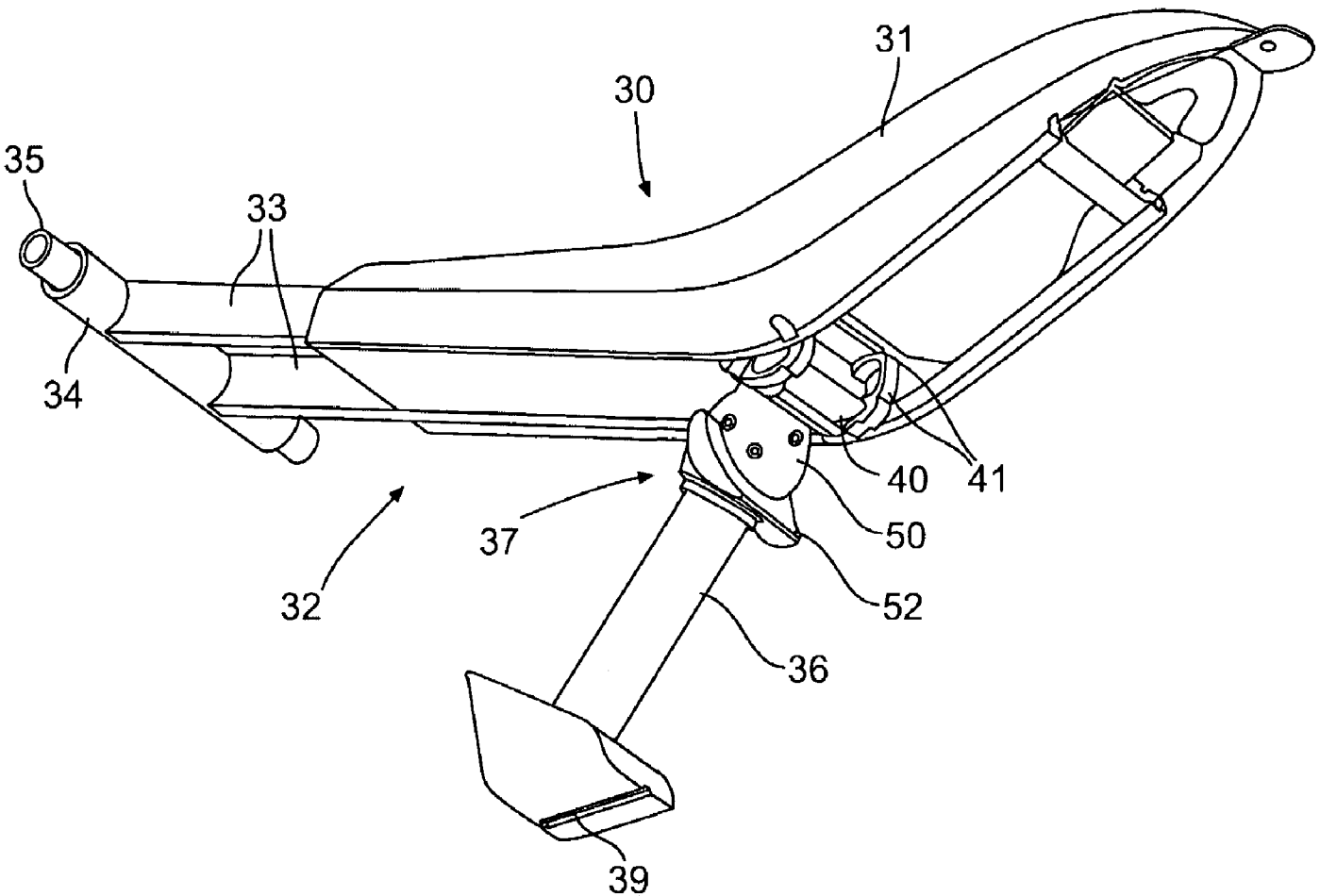
FIG. 7 is a perspective view of the seat assembly.

Referring concurrently to FIGS. 6 and 7, the seat assembly 30 has the seat portion 31 and a support portion 32, that are assembled in a storable configuration, by which the seat assembly 30 will be displaceable between a collapsed position (as in FIG. 2) and in seating positions (as in FIGS. 3 and 4). The seat portion 31 is a cushion having suitable resilience for comfort of the rider. The seat portion 31 typically has a base of closed-cell foamed plastic, with an opened-cell foamed plastic layer sandwiched between the base and a waterproof outer layer (leather cloth, or other finish plastics).

The support portion 32 supports the seat portion 31 onto the deck 12 of the PWC 10. More specifically, the support portion 32 has a pair of spaced arms 33 that are shaped to support the seat portion 31. Forward ends of the arms 33 intersect a connector sleeve 34, by which the seat assembly 30 is connected to the steering assembly 20 (FIG. 1). A pivot rod 35 will have opposed ends thereof secured to the steering assembly 20 (FIG. 1). The pivot rod 35 will be releasably received in the connector sleeve 34, such that the seat assembly 30 is pivotable with respect to the steering assembly 20 (FIG. 1). This configuration will be used to displace the seat assembly 30 to its collapsed position, in the stand-up configuration of the PWC 10, as will be described hereinafter. It is pointed out that the rotational degree of freedom between the steering assembly 20 and the seat assembly 30 could be lockable, and this feature will be used to lock the seat assembly 30 in its seating position.

The support portion 32 has a shaft 36 that connects the seat assembly 30 to the deck 12 of the PWC 10. A pivot mechanism 37 interconnects the shaft 36 with the arms 33. The shaft 36 has an end connector portion 38 (FIG. 6) at a bottom end thereof, so as to be interconnected with a base connector portion 39 (FIG. 7), received in the deck 12.

Figure 8:
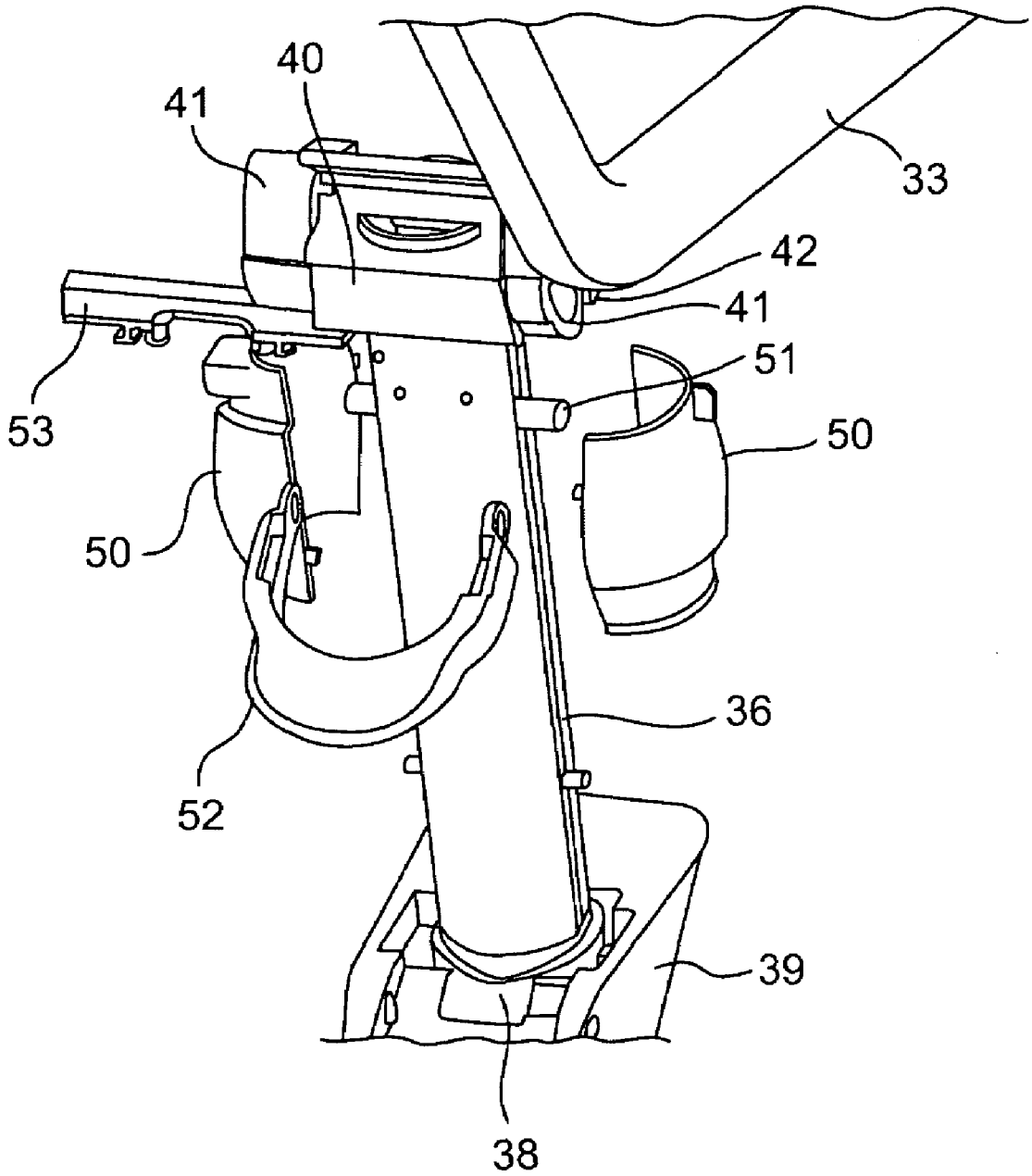
FIG. 8 is an exploded view of a pivot mechanism of the seat assembly.
Figure 9:
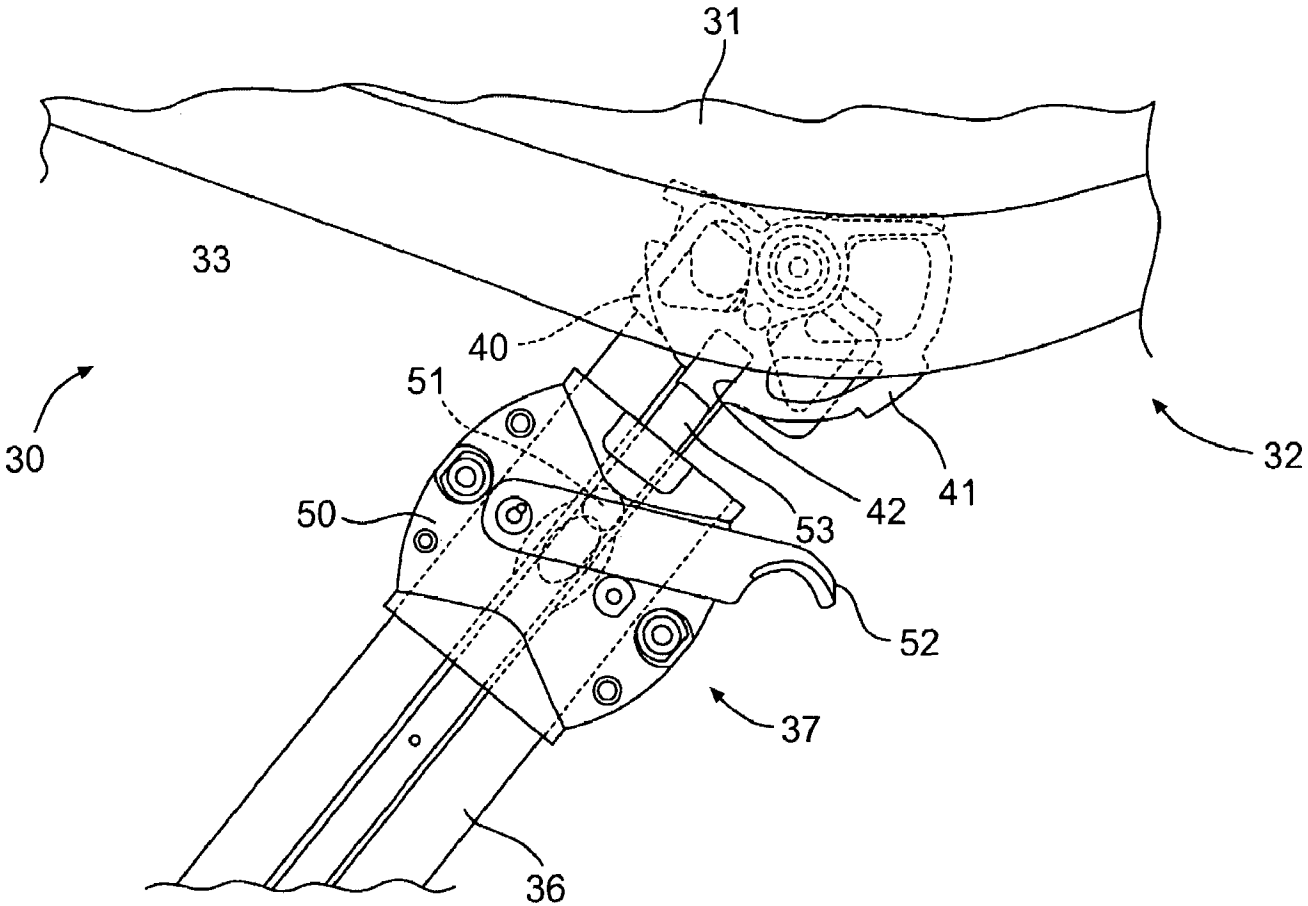
FIG. 9 is a side elevation view of the pivot mechanism in an unlocked position of a shaft of the seating assembly.
Figure 10:
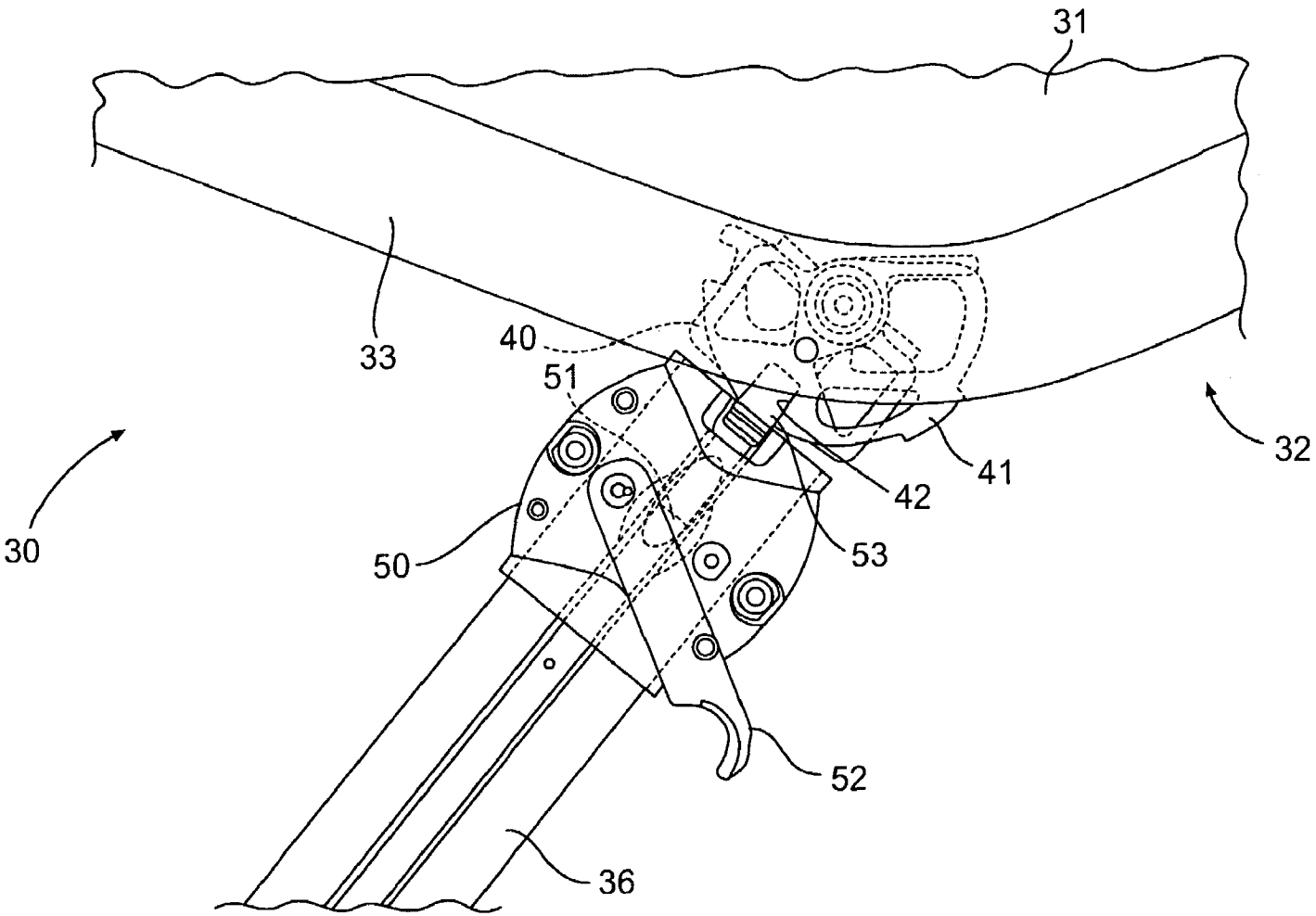
FIG. 10 is a side elevation view of the pivot mechanism in a locking position of the shaft.

Referring to FIGS. 8, 9 and 10, the pivot mechanism 37 is shown in greater detail. The pivot mechanism 37 has a head 40, that is pivotally connected to the arms 33. Ears 41 are provided on opposed sides of the head 40. As opposed to the head 40, the ears 41 are fixed to the arms 33. The ears 41 have position slots 42 in their outer periphery.

The pivot mechanism 37 also has a sleeve 50, displaceable longitudinally along the shaft 36. The sleeve 50 is separable in halves (FIG. 8), so as to be installed onto the shaft 36. Pin 51 protrudes from the shaft 36, and is immovable with respect to the shaft 36. A lever 52 is pivotally mounted on the sleeve 50, and interacts with the pin 51 so as to displace the sleeve 50 in a reciprocal motion on the shaft 36, using the pins 51 as purchase. A bar 53 is connected to a top end of the sleeve 50, and is displaceable with the sleeve 50.

Referring to FIG. 9, the bar 53 is shown disengaged from the ears 41, whereby the shaft 36 and the arms 33 are pivotable with respect to the seat portion 31. Referring to FIG. 10, the bar 53 is shown engaged into one of the position slots 42 in each of the ears 41. Accordingly, the seat portion 31 and the arms 33 are locked in this position to the shaft 36. When the bar 53 is locked into the position slots 42 of the ears 41, the lever 52 locks the sleeve 50 to the shaft 36. For instance, this may be achieved by the lever 52 pressing both halves of the sleeve 50 against the shaft 36. The lever 52 must therefore be manually released in order to remove the bar 53 from the position slots 42.

As shown in FIGS. 9 and 10, there are two pairs of position slots 42. One of the pairs of position slots 42 corresponds to the straddle seating configuration, and the other corresponds to the karting seating configuration of the PWC 10.

Figure 11:
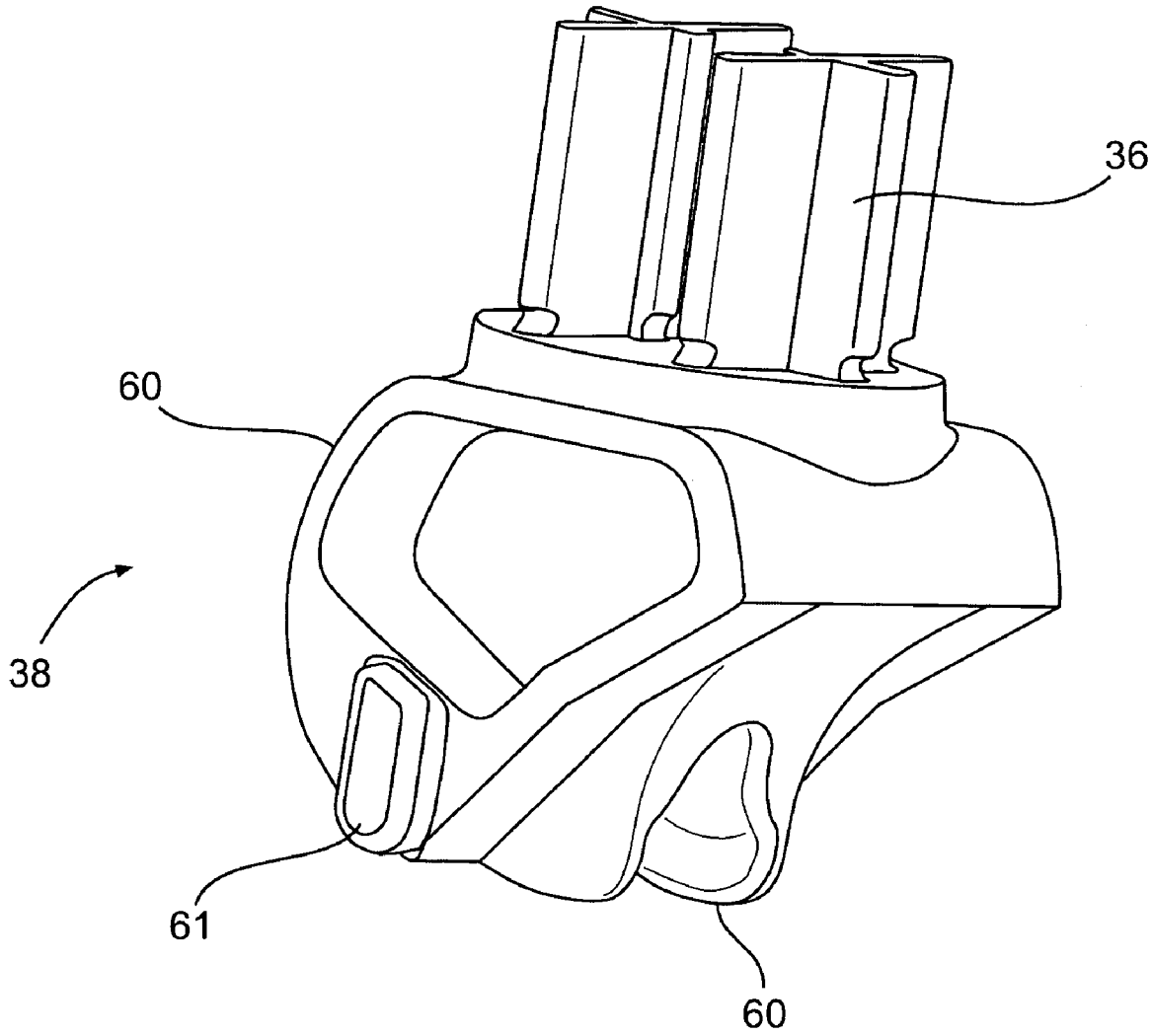
FIG. 11 is a perspective view of an end connector portion of the seat assembly.
Figure 12:
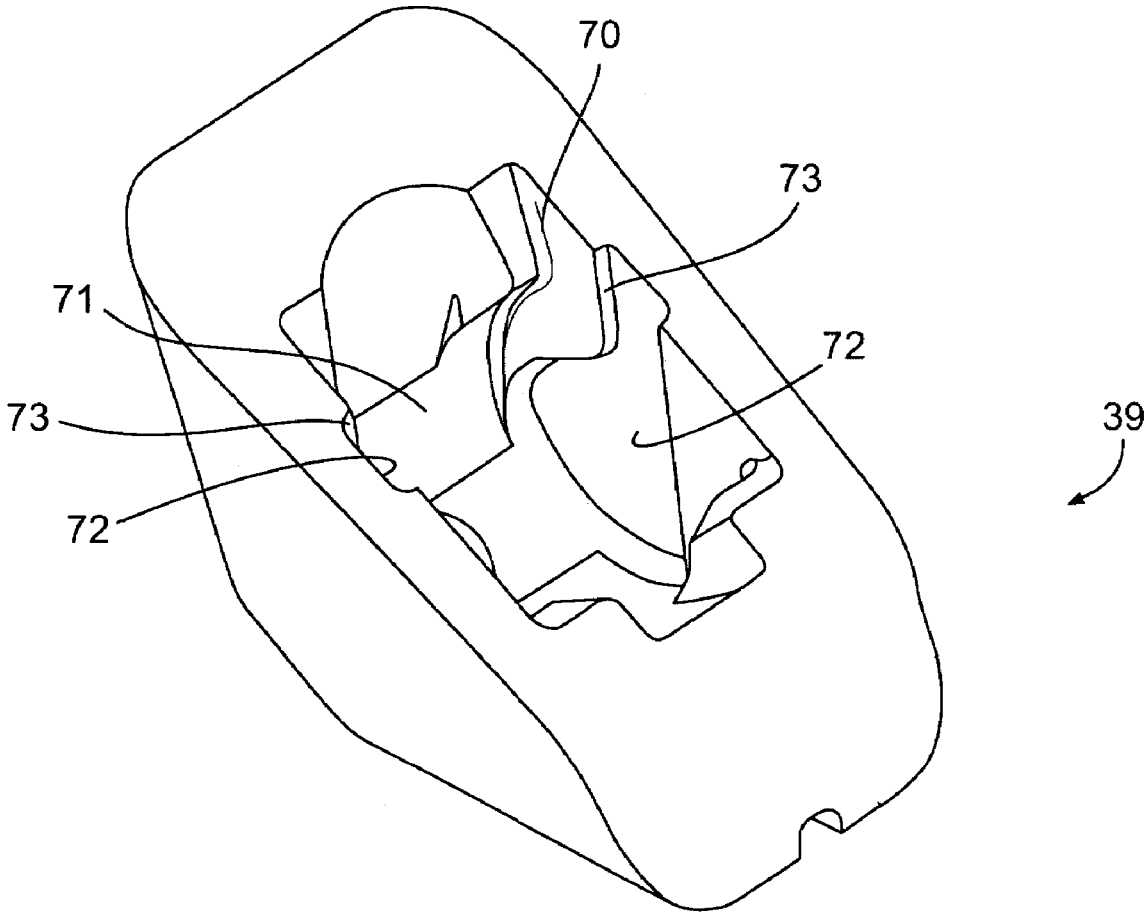
FIG. 12 is a perspective view of a base connector portion of the seat assembly.

Referring concurrently to FIGS. 11 and 12, the end connector portion 38 and the base connector portion 39 are shown. The end connector portion 38 is secured to the shaft 36, and has a semi-circular periphery 60. A pair of ears 61 (only one of which is seen in FIG. 11) are provided on the lateral surfaces of the end connector portion 38.

The base connector portion 39 is fixed in the deck 12. As shown in FIG. 3, the base connector portion 39 is where the shaft 36 is connected to the deck 12. Preferably, the base connector portion 39 is not in the standing surface 16, so as not to be stepped on by a rider using the PWC 10 in its stand-up configuration. The end connector portion 38 is received in a cavity 70 of the base connector portion 39. The cavity 70 has a semi-circular volume 71 that corresponds to the semi-circular periphery 60 of the end connector portion 38. Lateral sides of the cavity 70 are provided with cutouts 72, which receive the ears 61 of the end connector portion 38 when the latter is connected to the base connector portion 39. Ears 61 help guiding vertical insertion. A door (not shown) could be used to prevent removing end connector portion 38 from inside the base connector portion 39.

More specifically, the cutouts 72 each define a throat 73 that is slightly larger than the ears 61. Accordingly, the ears 61 must be aligned with the throats 73 for the end connector portion 38 to enter/exit the cavity of the base connector portion 39. When the end connector portion 38 is received in the base connector portion 39, a rotational joint is formed therebetween. The ears 61 keep the end connector portion 38 and the round shape connected to the base connector portion 39.

In the straddle seating configuration (illustrated in FIG. 3), it is a combination of the steering assembly 20 being locked in position with respect to the deck 12, and the pivot mechanism 37 locking the shaft 36 to the seat portion 20, that will keep the seat assembly 30 fixed to the PWC 10. Both the steering assembly 20 and the pivot mechanism 37 will have to be unlocked for the seat assembly 30 to be displaced through its straddle configuration.

Conversion of the PWC between Configurations

In order to be converted from the straddle seating configuration of FIG. 3 to the stand-up configuration of FIG. 2, the seat assembly 30 must be displaced to its collapsed position.

The shaft 36 must firstly be released from the deck 12. The pivot mechanism 37 is unlocked (as shown in FIG. 9) as well as the rotational degree of freedom between the steering assembly 20 and the seat assembly 30, so as to allow pivoting motion between the shaft 36 and the seat portion 31. As described for FIGS. 11 and 12, the shaft 36 may thus be within the base connector portion 39 so as to align the ears 61 of the end connector portion 38 with the throats 73 of the cavity 70, for the shaft 36 to be pulled out from connection with the base connector portion 39.

Figure 13:
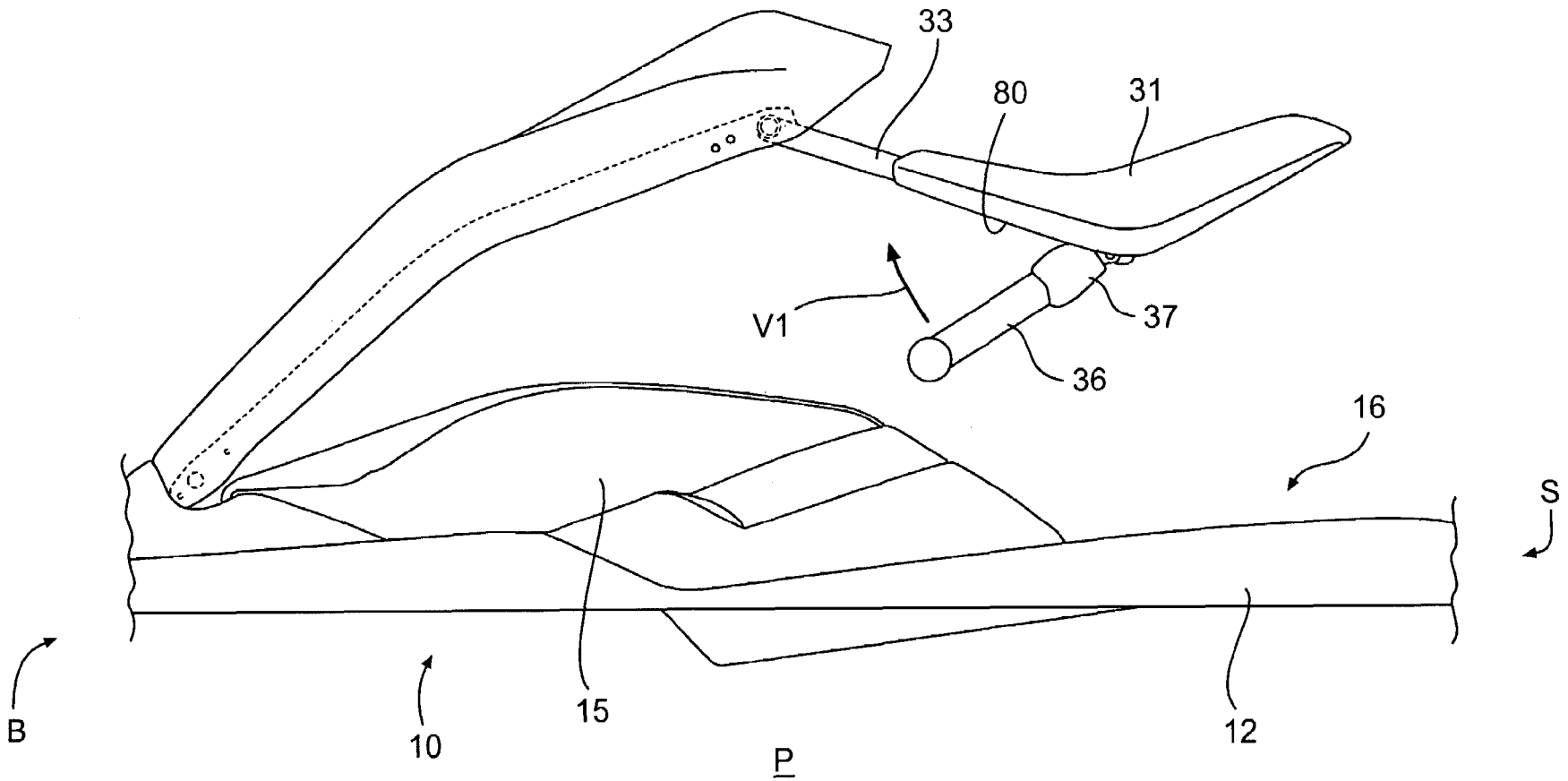
FIG. 13 is a port-side elevation view of the personal watercraft without the hull, with the shaft being jackknifed to a seat portion of the seat assembly.
Figure 14:
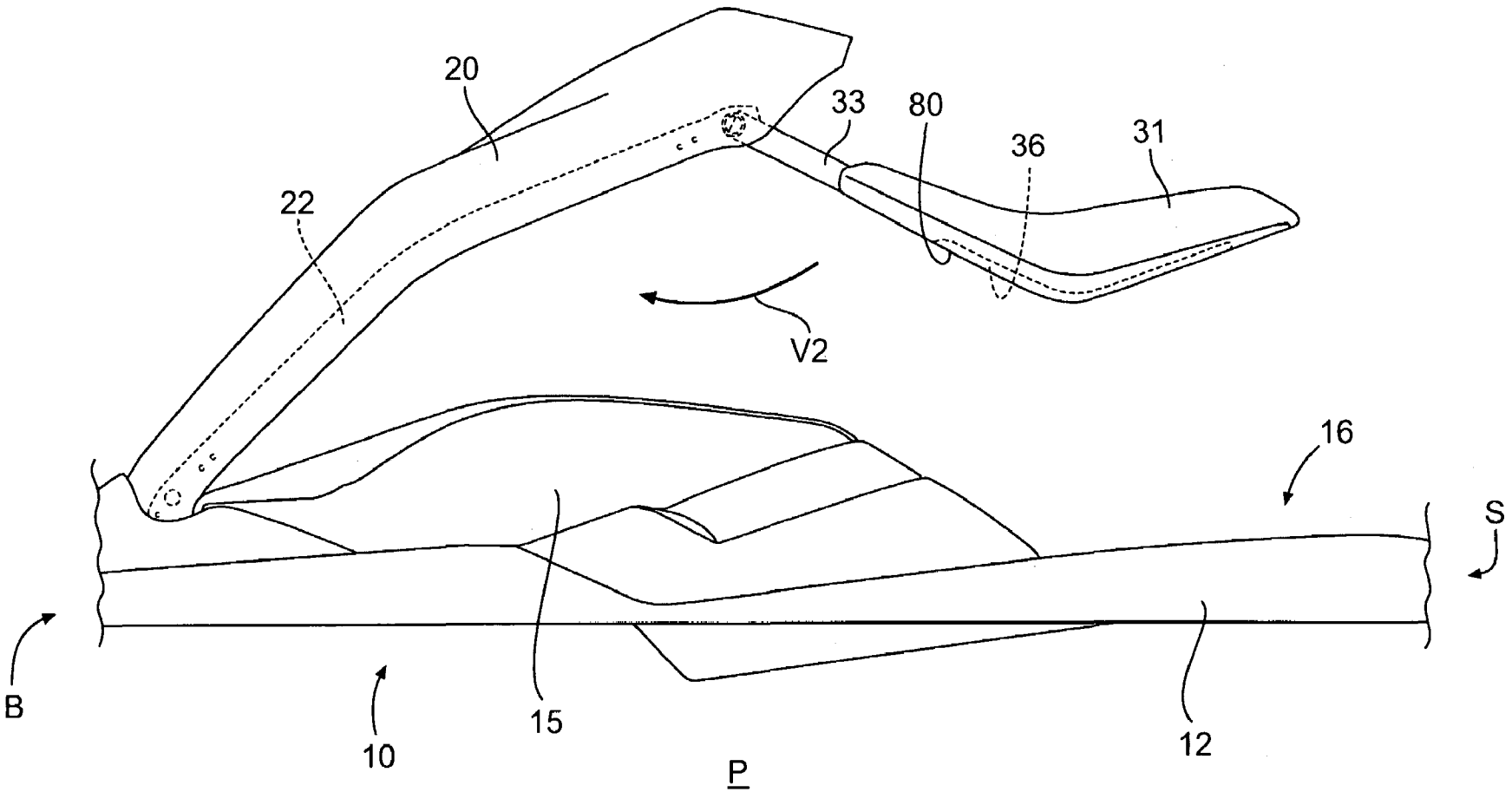
FIG. 14 is a port-side elevation view of the personal watercraft without the hull, with the seat assembly being jackknifed to a steering assembly or a pole assembly of the personal watercraft.

Therefore, as shown in FIG. 13, once released from the deck 12, the shaft 36 may be jackknifed to the seat portion 31, as shown by direction V1. As shown in FIG. 14, the shaft 36 is received between the arms 33 of the seat assembly 30. A latch mechanism (not shown) may be provided to lock the shaft 36 between the arms 33. Alternatively, the pivot mechanism 37 (FIGS. 9, 10 and 11) may provide a locking position for the shaft 36 positioned between the arms 33.

Figure 15:
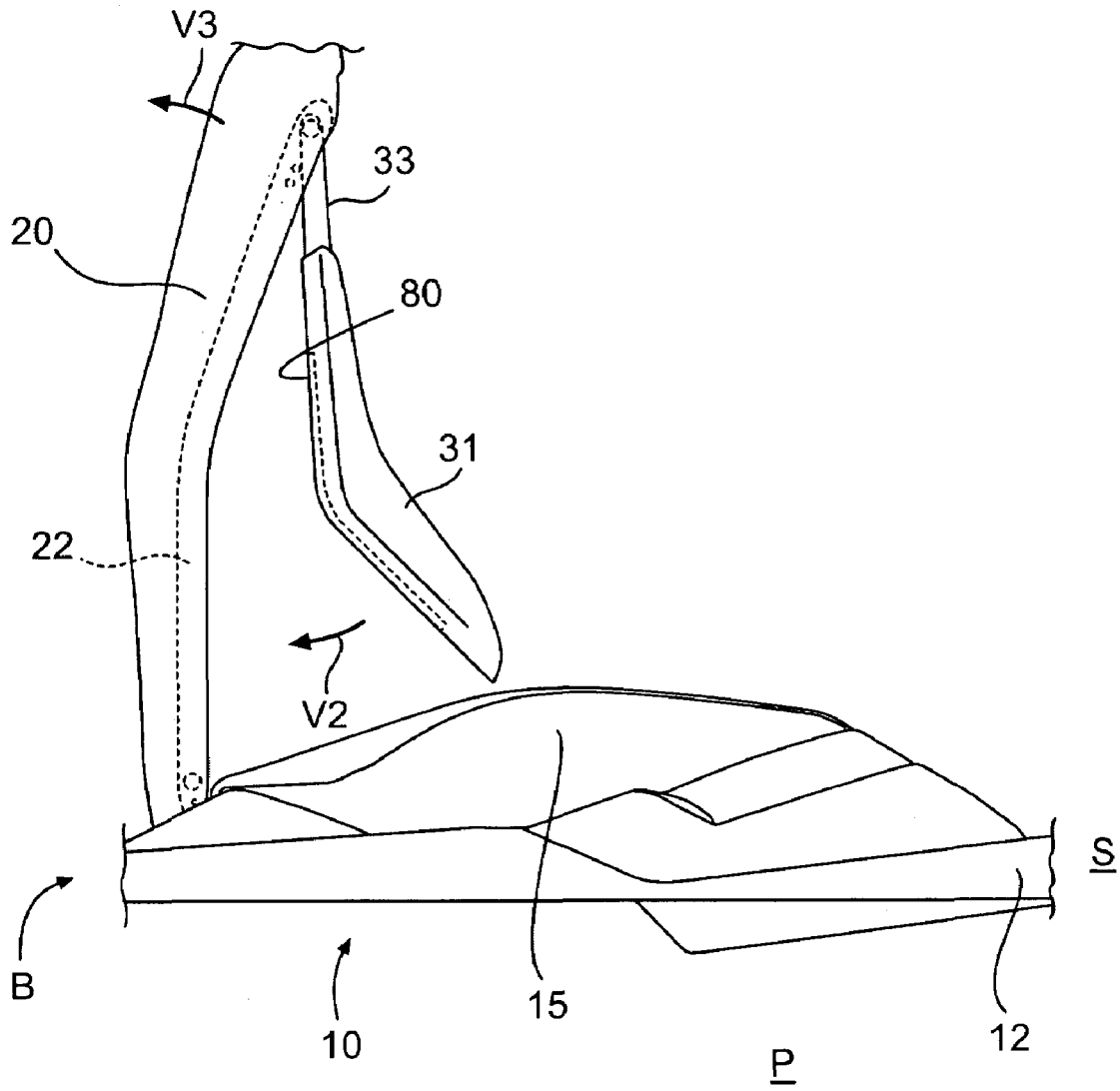
FIG. 15 is a port-side elevation view of the personal watercraft without the hull, in a further sequence of jackknifing of the seat assembly to the steering assembly of the personal watercraft.

Referring to FIG. 14, the seat assembly 30 is then pivoted toward the steering assembly 20, as shown by direction V2. The steering assembly 20 is pivoted along direction V3 such that the seat assembly 30 may overcome the engine cover 15, as shown in FIG. 15, to be jackknifed to the steering assembly 20. It is pointed out that the steering assembly 20 need only be pivoted if there is not sufficient clearance between the engine cover 15 and the seat assembly 30. As shown in FIG. 15, the seat assembly has a latch pin 80, that will be caught by a latch mechanism (not shown) in the steering assembly 20, so as to releasably secure the seat assembly 30 to the steering assembly 20.

Figure 16:
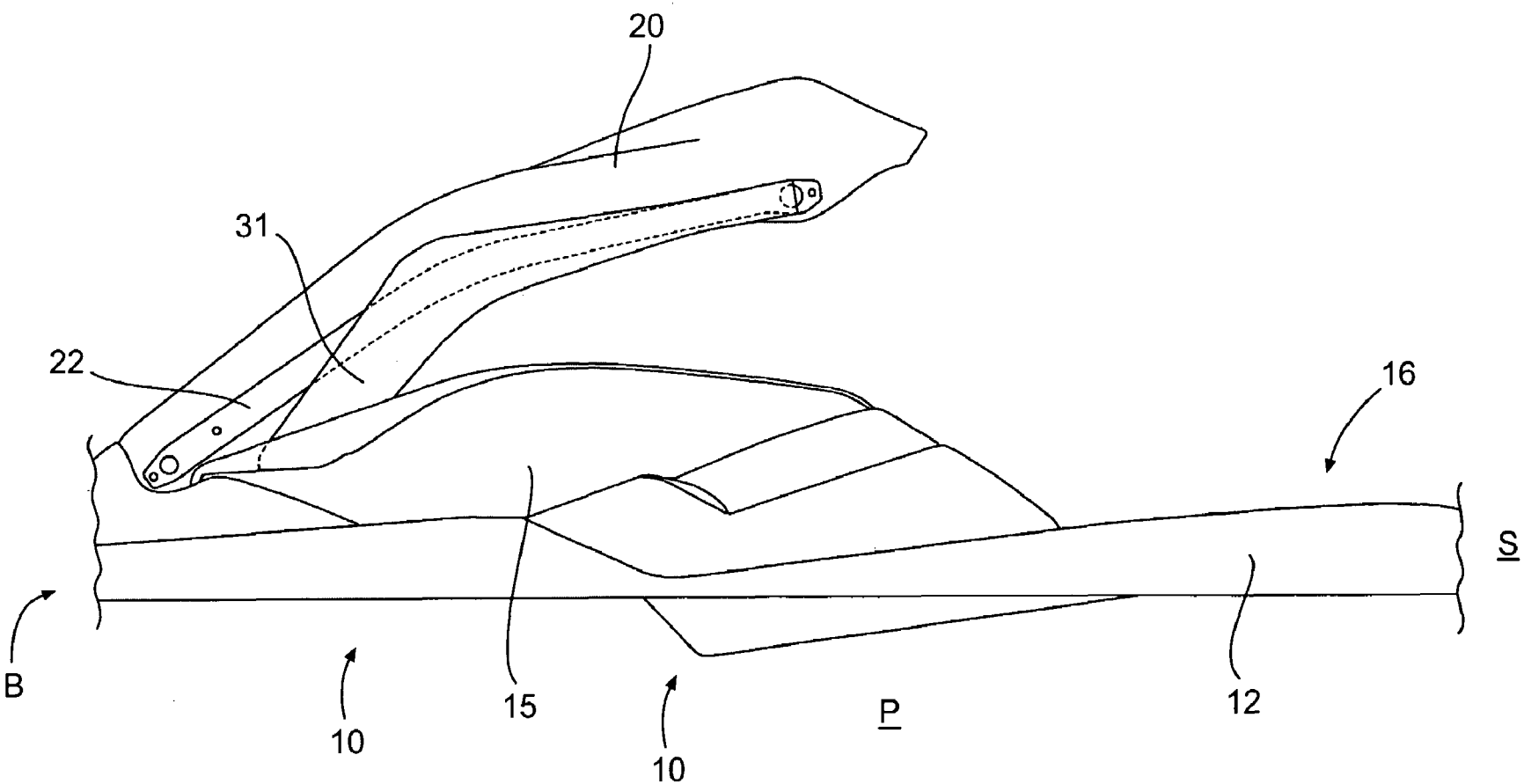
FIG. 16 is a port-side elevation view of the personal watercraft without the hull, with the seat assembly being jackknifed to the steering assembly in the stand-up configuration of the personal watercraft.

Referring to FIG. 16, the steering assembly 20 is then lowered to an appropriate height for stand-up riding of the PWC 10, as shown in FIG. 2. Alternatively, the steering assembly 20 may be further lowered to reach the storage configuration of the PWC 10.

The above steps are reversed in order to convert the PWC 10 from the stand-up configuration of FIG. 2, to the straddle and karting seating configurations of FIGS. 3 and 4, respectively.

It is pointed out that in the karting seating configuration of FIG. 4 (i.e., with the rider in the karting sitting position), the seat assembly 30 remains in its collapsed position. More particularly, as shown in FIG. 4, the shaft 36 remains with the arms 33, such that the arms 33 lie directly on the deck 12 of the PWC 10. Latch connectors or the like are preferably provided to releasably secure the seat assembly 30 to the deck 12. As shown in FIG. 4, a backrest 90 may be releasably secured to the seat assembly 30 to provide support to the rider in the karting sitting position.

Other storable configurations are contemplated. For instance, a seat assembly could be pivotally mounted to the deck, so as to be received below the standing surface 16 of the deck 12. Alternatively, the seat assembly could be received in the engine cover 15.

It is within the ambit of the present invention to cover any obvious modifications of the embodiments described herein, provided such modifications fall within the scope of the appended claims.

The invention claimed is:

1. A personal watercraft comprising:

a hull;

a deck supported by the hull, the deck having a standing surface;

a steering assembly pivotably mounted on the deck at a first end of the steering assembly, forward of the standing surface, the steering assembly having a steering handle disposed on a second end of the steering assembly;

a jet propulsion unit supported by the hull, including an inlet for taking in water, an impeller assembly for generating a pressurized stream of water, an outlet for discharging the pressurized stream of water, and a movable element positioned at the outlet for selectively directing the pressurized stream of water, wherein the movable element is operatively connected to the steering handle and directs the pressurized stream of water based on signals from the steering handle; and a seat assembly displaceably supported by the deck such that the seat assembly is pivotably displaceable between a first position, in which the seat assembly is pivotably connected to the steering assembly and is positioned above the standing surface, such that an operator of the watercraft can be seated on the seat assembly, and a second position, in which the seat assembly is stored in the personal watercraft and supported by the steering assembly, so that the standing surface is unencumbered, such that the operator of the watercraft can stand on the standing surface.

2. The personal watercraft according to claim 1, wherein at least part of the seat assembly is retained in the steering assembly when in the second position.

3. The personal watercraft according to claim 1, wherein the seat assembly is pivotally mounted to the steering assembly, so as to be pivotally displacable between the first position and the second position.

4. The personal watercraft according to claim 1, wherein the seat assembly has a seat portion and a support portion for supporting the seat portion above the standing surface in the first position of the seat assembly.

5. The personal watercraft according to claim 4, wherein the support portion has a shaft having a connector portion at a first end thereof, for connection with the deck in the first position of the seating assembly, and a pivot portion at a second end thereof, such that the shaft may be jackknifed to the seat portion in the second position.

6. The personal watercraft according to claim 5, wherein the support portion has an arm pivotally connected to the steering assembly, for the seat assembly to be jackknifed to the steering assembly in the second position of the seat assembly, with the shaft of the support portion being jackknifed to the seat portion.

7. The personal watercraft according to claim 5, wherein the shaft of the support portion is lockable in a first shaft position and a second shaft position with respect to the seat portion, the first shaft position of the shaft corresponding to a straddle subposition of the first position of the seat assembly, in which a rider of the personal watercraft is straddle seated on the seat assembly, the second shaft position corresponding to a karting subposition of the first position of the seating assembly, in which a rider of the personal watercraft is in a karting sitting position.

8. The personal watercraft according to claim 4, wherein the support portion has an arm pivotally connected to the steering assembly, for the seat assembly to be jackknifed to the steering assembly in the second position of the seat assembly.

9. The personal watercraft according to claim 1, wherein the first position includes a straddle subposition, in which a rider of the personal watercraft is in a straddle sitting position, and a karting subposition, in which a rider of the personal watercraft is in a karting sitting position.

10. The personal watercraft according to claim 1, wherein the steering assembly is displaceable so as to rest on the deck of the personal watercraft with the seat assembly in the second position, in a storage configuration of the personal watercraft.

11. A method for storing a seat assembly pivotably connected to a steering assembly of a personal watercraft, comprising the steps of:

releasing the seat assembly from a seating position on a deck of the personal watercraft; and pivoting the seat assembly in respect to a steering assembly to a collapsed position in the personal watercraft, such that the seat assembly is received at least in part in a space in the steering assembly of the personal watercraft in the collapsed position.

12. The method according to claim 11, further comprising the step of configuring the seat assembly for storage, prior to pivoting the seat assembly to collapsed position.

13. The method according to claim 12, wherein the step of configuring the seat assembly for storage includes jackknifing a support portion of the seat assembly to a seat portion of the seat assembly.

14. The method according to claim 11, wherein the step of releasing the seat assembly from the seating position on the deck of the personal watercraft is achieved by unlocking pivot joints retaining the seat assembly in the seating position so as to allow a seat portion of the seat assembly to pivot with respect to a support portion of the seat assembly, and by disconnecting the support portion away from the deck of the personal watercraft.

15. The method according to claim 14, further comprising the step of configuring the seat assembly for storage, prior to pivoting the seat assembly to collapsed position.

16. The method according to claim 15, wherein the step of configuring the seat assembly for storage includes jackknifing the support portion of the seat assembly to the seat portion of the seat assembly.

* * * * *